US007978055B2

(12) United States Patent
Garcia

(10) Patent No.: US 7,978,055 B2
(45) Date of Patent: Jul. 12, 2011

(54) VIRTUAL MESERO POS TABLE

(76) Inventor: Alien Garcia, Naples, FL (US)

( * ) Notice: Subject to any disclaimer, the term of this patent is extended or adjusted under 35 U.S.C. 154(b) by 388 days.

(21) Appl. No.: 11/999,289

(22) Filed: Dec. 5, 2007

(65) Prior Publication Data

US 2008/0127864 A1 Jun. 5, 2008

Related U.S. Application Data

(60) Provisional application No. 60/868,574, filed on Dec. 5, 2006, provisional application No. 60/868,576, filed on Dec. 5, 2006.

(51) Int. Cl.
*G08B 5/36* (2006.01)

(52) U.S. Cl. ..... 340/286.09; 340/332; 340/815.4

(58) Field of Classification Search ..... 340/286.09, 340/332, 825.57, 825.62, 825.69, 825.71, 340/825.72, 815.4, 286.06
See application file for complete search history.

(56) References Cited

U.S. PATENT DOCUMENTS 4,638,312 A 1/1987 Quinn et al.
5,235,509 A 8/1993 Mueller et al.
5,323,695 A * 6/1994 Borgman et al. ..... 108/147
5,583,539 A * 12/1996 Hiketa et al. ..... 715/823
5,992,301 A * 11/1999 Mukumoto ..... 99/330
6,081,356 A * 6/2000 Branc et al. ..... 398/129
6,208,976 B1 3/2001 Kinebuchi et al.
6,636,835 B2 * 10/2003 Ragsdale-Elliott et al. .... 705/15
6,810,343 B2 * 10/2004 McKee ..... 702/81
6,914,582 B2 7/2005 Tanaka
7,029,128 B2 * 4/2006 Nishio et al. ..... 353/94
2003/0213840 A1 * 11/2003 Livingston et al. ..... 235/375
2006/0218040 A1 9/2006 Sabapathypillai

* cited by examiner

*Primary Examiner* — Daniel Previl
(74) *Attorney, Agent, or Firm* — James Ray & Assoc

(57) ABSTRACT

A table designed for use in a restaurant. The table enables a patron of such restaurant to communicate with at least one of a hostess, waiter, waitress, chef and manager at such restaurant. The said table includes at least one leg member. A table top, having a predetermined configuration, is secured to the at least one leg member. Such table top includes at least one screen formed in a top surface thereof to enable viewing pre-selected information. A terminal control panel engages with the table top for at least indicating at least one of the table is in use, the table is being cleaned and the table is ready for seating a patron. Finally, there is a computer device that includes a server connected to the table for communicating with at least one of a hostess, waiter, waitress, chef and manager at such restaurant.

20 Claims, 2 Drawing Sheets

VIRTUAL MESERO POS TABLE

CROSS REFERENCE TO RELATED APPLICATION

This patent application is related to and claims priority from U.S. Provisional Patent Application Ser. No. 60/868,574 filed Dec. 5, 2006 and to U.S. Provisional Patent Application Ser. No. 60/868,576 filed Dec. 5, 2006 titled "Automated Business Process", and the utility Patent Application relating thereto also being filed concurrently herewith. Each of these applications is incorporated herein by reference thereto.

FIELD OF THE INVENTION

The present invention relates, in general, to restaurant type tables and, more particularly, this invention relates to a restaurant table which allows the customer to send their own order directly to the chef, entertain themselves, and pay for their final order.

BACKGROUND OF THE INVENTION

Prior to the conception and development of the present invention, as is generally well known in the prior art, a waiter or waitress would come to the table and take an order for food and beverages from the patron. In many instances, such person taking the order may not hear the customer correctly and write the wrong thing down on the order. When this happens the food is often times sent back thereby causing the restaurant owner money.

Another problem is that the time the food order is given to the chef is not available on the order and the chef may take such order out of turn thereby causing an unhappy patron due to a delay in receiving their food.

Additionally, the tables presently available to restaurants are not usually pleasing to the sight of the customer and are certainly not equipped to provide pre-selected entertainment to such customer. Nor are the prior art type tables presently available equipped to allow the customer to pay the tab at the table with their credit card.

SUMMARY OF THE INVENTION

The present invention provides a table for use in a restaurant. The table enables a patron to communicate with at least one of a hostess, waiter, waitress, chef and manager at such restaurant. Such table includes at least one leg member. There is a table top, having a predetermined configuration, secured to such at least one leg member. The table top includes at least one screen formed in a top surface thereof to enable viewing pre-selected information. A terminal control panel is engageable with the table top for at least indicating at least one of the table is in use, the table is being cleaned and the table is ready for seating another patron. Finally, the table includes a computer means including a server connected to such table for communicating with at least one of a hostess, waiter, waitress, chef and manager at such restaurant.

OBJECTS OF THE INVENTION

It is, therefore, one of the primary objects of the present invention to provide a restaurant type table which allows a customer to place an order for food directly with the chef thereby eliminating possible error be a waiter or waitress.

Another object of the present invention is to provide a restaurant type table which allows a customer to pay the tab with their credit card without the assistance of the waiter or waitress thereby saving time for both the customer and the server.

Still another object of the present invention is to provide a restaurant type table which can provide the customer with pre-selected entertainment while waiting on their order to be delivered.

Yet another object of the present invention is to provide a restaurant type table which incorporates a touch screen to enable the customer to enter their orders.

An additional object of the present invention is to provide a restaurant type table which has a built in touch screen display to search the web, watch television programming, provide advertising, and/or play games. The table can also accommodate any other software you wish to provide for your patrons.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
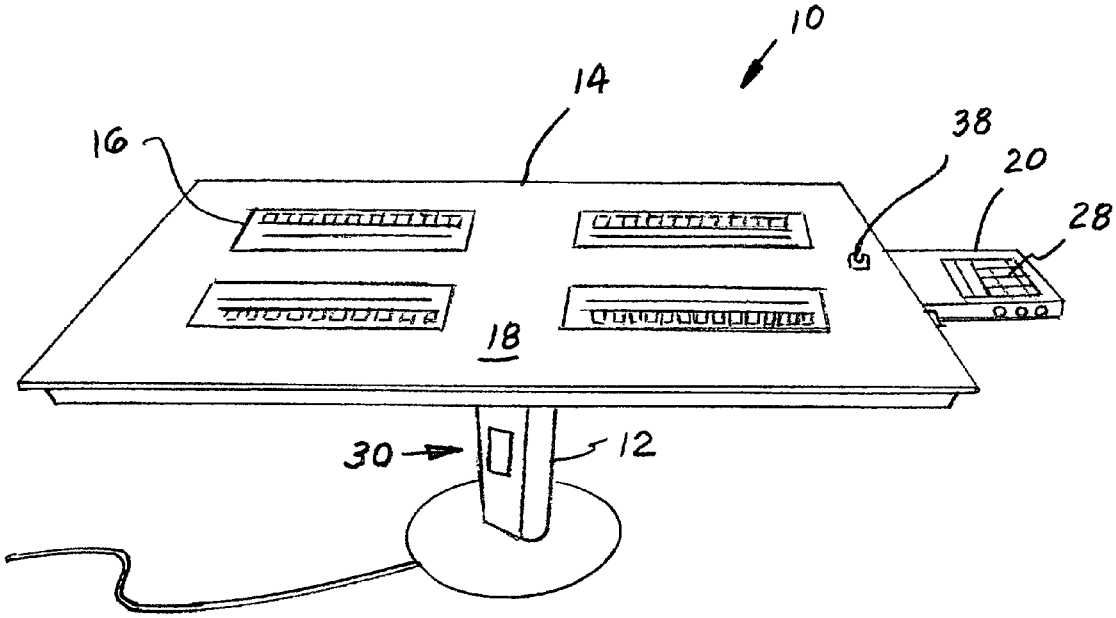
FIG. 1 is a perspective view of a presently preferred point of service table for use in a restaurant to at least take orders and pay the tab.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
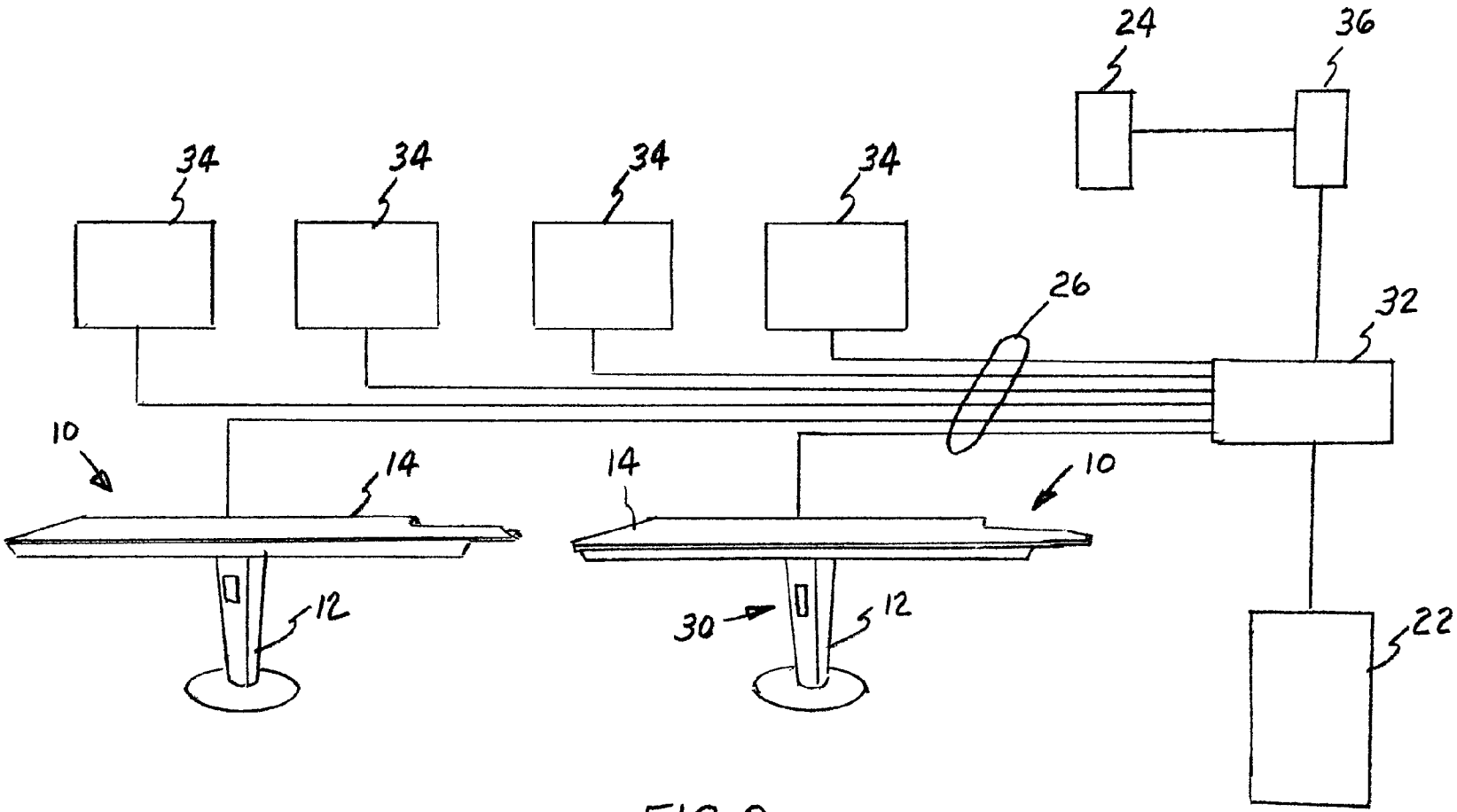
FIG. 2 is a schematic diagram illustrating the hardware associated with the table illustrated in FIG. 1.

Reference is now directed, more particularly, to FIGS. 1 and 2. Illustrated therein is a table, generally designated 10, for use in seating a predetermined number of patrons thereat in a restaurant and which enables a patron to remotely communicate with at least one of a hostess, waiter, waitress, chef and manager at such restaurant. In the presently preferred embodiment of the instant invention, such communication will be possible with each of such hostess, waiter, waitress, chef and manager.

The table 10 includes at least one leg member 12. It is within the scope of the present invention to have a plurality of leg members 12 which in most cases would depend on a predetermined configuration of a table top 14 which is engageable with and secured to the top of such at least one leg member 12. Such predetermined configuration may be selected from round, rectangular, hexagonal and oval. In the presently preferred embodiment of the invention, however such predetermined configuration is rectangular.

Additionally, the table top 14 includes at least one screen member 16 disposed in a top surface 18 thereof to enable viewing pre-selected information. Preferably, such table top 14 will include a predetermined plurality of screens 16 disposed in the top surface 18 thereof according to a pre-selected arrangement. The predetermined plurality of screens 16, preferably, being equal to a seating capacity for the table 10. Further in the presently preferred embodiment, the table 10 further includes a sealing means 24, preferably an elastomer type sealing means, for sealing between the at least one screen 16 and such table top 14 to prevent liquid spills from entering the at least one screen 16.

In the presently most preferred embodiment of the invention, the pre-selected information at least includes a menu to be viewed on the at least one screen member 16. It is also within the scope of the presently preferred embodiment of the invention that such pre-selected information further includes at least one of television programs, games and access to pre-selected web sites. In the most preferred embodiment such pre-selected information includes each of such television programs, games and access to the pre-selected web sites.

The table 10 further includes a terminal control panel, generally designated 20, which engages the table top 14 for at least indicating at least one of the table 10 is in use, such table 10 is being cleaned and such table 10 is ready for seating another patron. According to the presently preferred embodiment of the invention such terminal control panel 20 indicates each of such table 10 is in use, such table 10 is being cleaned and that the table 10 is ready for seating a patron. Also, the terminal control panel 20 includes a key pad 28.

There is also a computer means, generally designated 30, preferably disposed within the leg member 12, which includes a server 22 connected to the table 10 for communicating with the at least one of a hostess, waiter, waitress, chef and manager at such restaurant. When table 10 includes a predetermined plurality of screens 16, there will be provided a separate computer means 30 for each screen 16.

In the presently preferred embodiment of the invention the table 10 further provides a communication link 26 with a credit card reader 38 to enable such patron to pay their bill at such table 10 without requiring a person to take such credit card. Additional, the table 10 includes a wireless communication capability.

Connected to server 22 is a network switching mechanism 32. Such network switching mechanism 32 is connected via an interface device 34 to each of such patron's seating area and to the at least one of a hostess, waiter, waitress, chef and manager at such restaurant.

Finally, table 10 further includes a router mechanism 36 connected to said switching mechanism 32.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A table for use in seating a predetermined number of patrons thereat in a restaurant and which enables a patron to remotely communicate with at least one of a hostess, waiter, waitress, chef and manager at such restaurant, said table comprising:

a) at least one leg member;

b) a table top, having a predetermined configuration, engageable with and secured to said at least one leg member, said table top including at least one screen disposed in a top surface thereof to enable viewing pre-selected information;

c) a terminal control panel engageable with said table top for at least indicating at least one of said table is in use, said table is being cleaned and said table is ready for seating a patron; and d) a computer means including a server connected to said table for communicating with said at least one of a hostess, waiter, waitress, chef and manager at such restaurant;

wherein said table top includes a predetermined plurality of screens disposed in said top surface thereof, said predetermined plurality of screens being equal to a seating capacity for said table.

2. A table, according to claim 1, wherein said table further provides a communication link with a credit card reader to enable such patron to pay their bill at said table without requiring a person to take such credit card.

3. A table, according to claim 1, wherein said pre-selected information at least includes a menu to be viewed on said at least one screen.

4. A table, according to claim 3, wherein said pre-selected information further includes at least one of television programs, games and access to pre-selected web sites.

5. A table, according to claim 4, wherein said pre-selected information includes each of said television programs, games and access to pre-selected web sites.

6. A table, according to claim 4, wherein said table includes wireless communication capability.

7. A table, according to claim 6, wherein said terminal control panel includes a key pad.

8. A table, according to claim 1, wherein said predetermined configuration is selected from round, rectangular, hexagonal and oval.

9. A table, according to claim 8, wherein said predetermined configuration is rectangular.

10. A table, according to claim 1, wherein said terminal control panel indicates each of said table is in use, said table is being cleaned and said table is ready for seating a patron.

11. A table, according to claim 1, wherein said server communicates with each of such hostess, waiter, waitress, chef and manager.

12. A table, according to claim 1, wherein said table further includes a sealing means for sealing between said at least one screen and said table top to prevent liquid spills from entering said at least one screen.

13. A table, according to claim 12, wherein said sealing means is an elastomer.

14. A table, according to claim 12, wherein said at least one screen is a touch screen display.

15. A table, according to claim 1, wherein said computer means is disposed within said at least one leg member.

16. A table, according to claim 1, wherein said table includes a plurality of leg members.

17. A table, according to claim 1, wherein said table includes a separate computer means for each screen.

18. A table, according to claim 1, wherein said server includes a network switching mechanism.

19. A table, according to claim 18, wherein said network switching mechanism is connected via an interface device to each of such patron's seating area and to said at least one of a hostess, waiter, waitress, chef and manager at such restaurant.

20. A table, according to claim 19, wherein said table further includes a router mechanism connected to said switching mechanism.

* * * * *